United States Patent [19]

Raymond

[11] 4,030,156

[45] June 21, 1977

[54] BRIDGE EXPANSION JOINT

[75] Inventor: Paul J. Raymond, Troy, N.Y.

[73] Assignee: A. J. Harris & Sons, Inc., New Britain, Conn.

[22] Filed: Aug. 16, 1976

[21] Appl. No.: 714,853

[52] U.S. Cl. ..... 14/16.5; 404/69; 52/573

[51] Int. Cl.[2] ..... E01D 19/06

[58] Field of Search ..... 14/16.5; 404/69, 68, 404/47; 52/573, 396

[56] References Cited

UNITED STATES PATENTS

| | | | |
|---|---|---|---|
| 1,799,574 | 4/1931 | Ward | 14/16.5 |
| 2,013,195 | 9/1935 | Ward | 14/16.5 |
| 3,482,492 | 12/1969 | Bowman | 404/56 |
| 3,606,826 | 9/1971 | Bowman | 404/69 X |
| 3,648,423 | 3/1972 | Cole | 52/573 X |
| 3,788,758 | 1/1974 | Scheffel | 404/56 |
| 3,830,583 | 8/1974 | Becht | 404/69 |
| 3,904,304 | 9/1975 | Honegger | 404/69 |
| 3,907,443 | 9/1975 | McLean | 404/56 |

*Primary Examiner*—Nile C. Byers
*Attorney, Agent, or Firm*—Prutzman, Hayes, Kalb & Chilton

[57] ABSTRACT

An improved modular expansion joint having proportioning bars to provide support for and to center the beams which run longitudinally in the gap being joined. The proportioning bars extend across the gap under and at an angle to the beams. The ends of the bars slide in channels formed in the ends of the pavement sections being joined. As the gap narrows, the angle between the bars and the beams becomes more acute. Each beam is connected to at least a pair of bars and its position in the gap is thereby controlled. Removable caps are provided on each beam to accommodate replacement of the resilient seals between the beams.

17 Claims, 6 Drawing Figures

FIG. 1.
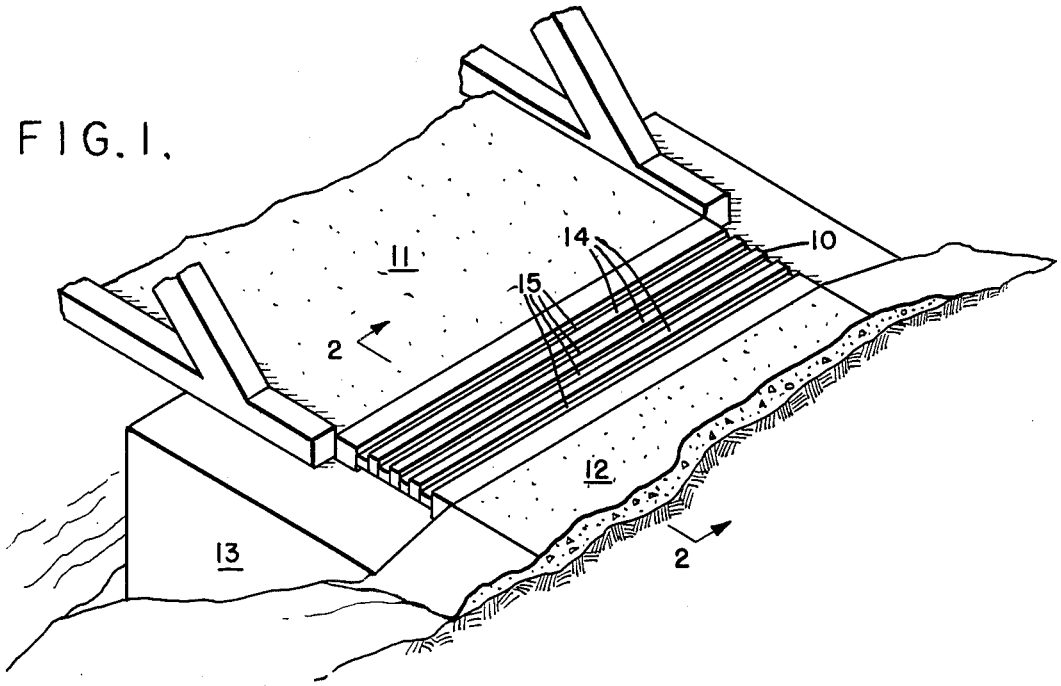
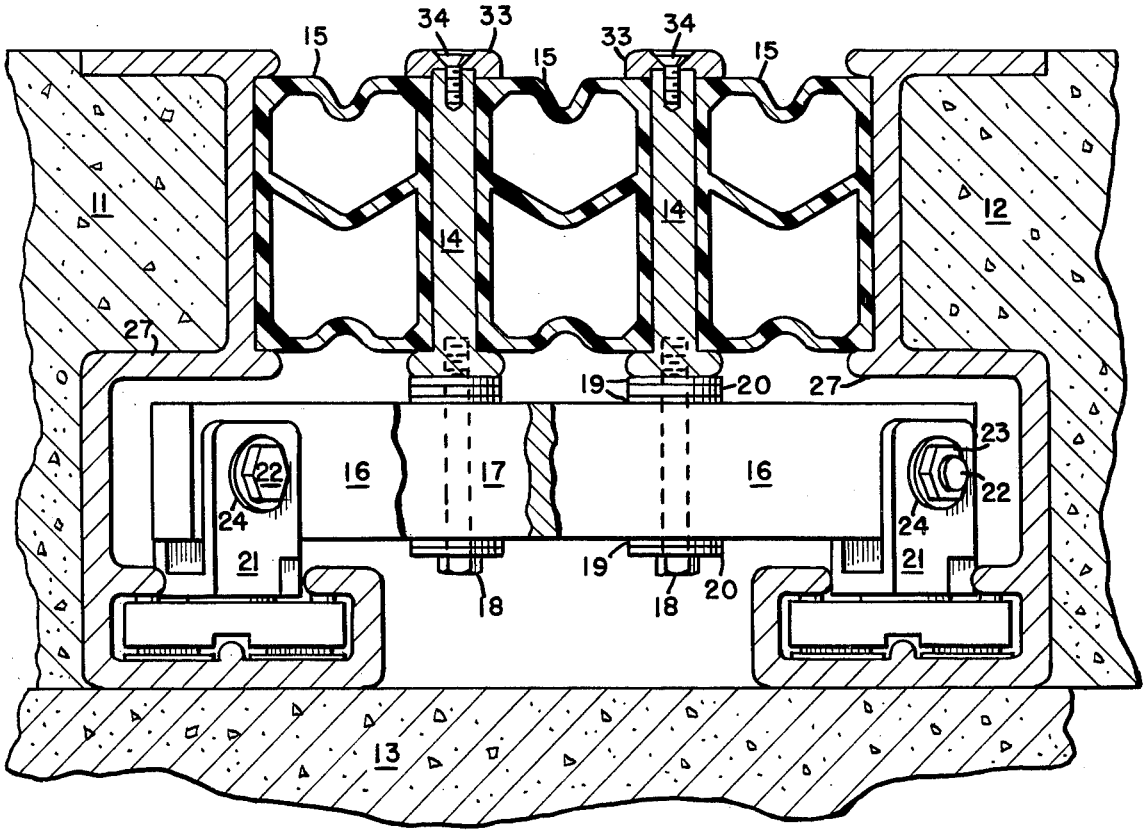
FIG. 2.

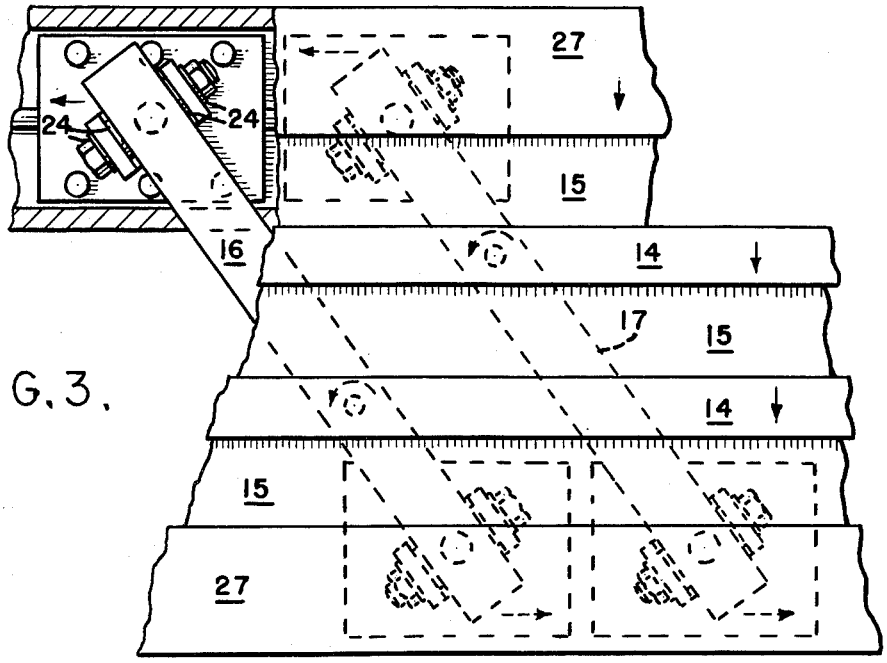
FIG. 3.
FIG. 4.
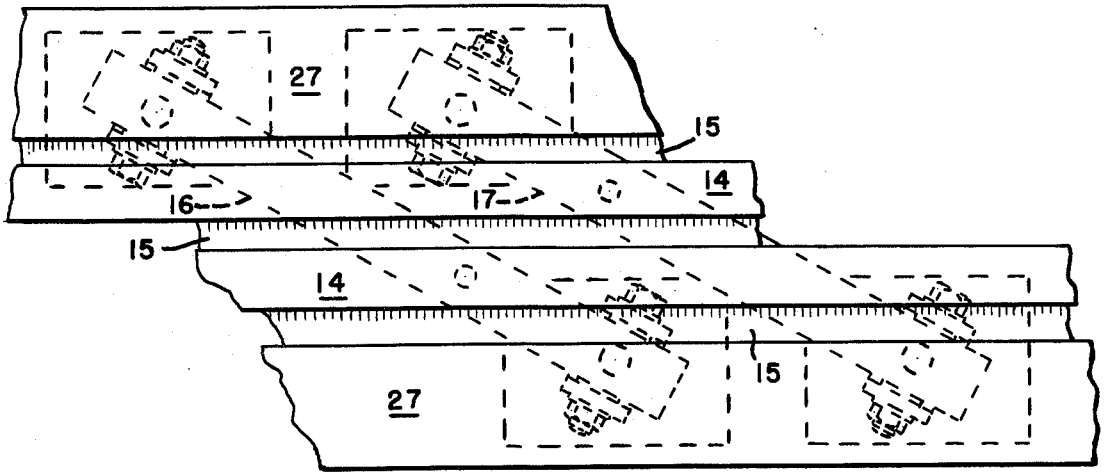

BRIDGE EXPANSION JOINT

BACKGROUND OF THE INVENTION

This invention relates to the field of road and bridge construction, and, more particularly, relates to the design of expansion joints for bridges and for other applications where the expansion and contraction of pavement sections must be accommodated.

In the past, various types of expansion joints have been devised such as those described in the following U.S. Pat. Nos. 3,830,583; 3,699,853 and 3,854,159. The expansion joints currently available typically provide for structual support members extending across the gap to be joined, generally at right angles thereto. This arrangement requires that a recess must be made in the ends of the pavement sections being joined sufficiently deep to accommodate the maximum anticipated travel or expansion in question. It would be desirable to eliminate the need for such a recess or to at least reduce it in size.

It is common to provide an expansion joint comprised of several rigid members or beams, the top surface of which serve as the road wearing surfaces, said beams being separated by resilient expansion seals. One of the difficulties with this type of design is that there is generally no means for equalizing the spacing between the beams with precision. One attempt at eequalizing this spacing and the resultant distribution of stress loading has been to utilize leaf springs as described in U.S. Pat. No. 3,830,583. Although this solution to the problem has been partially successful, it would be desirable to equalize the spacing and stress loading more precisely.

Another disadvantage of expansion joint designs presently in use concerns the method of anchoring the beams on their associated structual support members. Frequently, inadequate anchoring is used which permits too much vertical and rocking motion of the beam. As a result, many of these joints tend to produce loud slapping noises as vehicles and other traffic pass over them. Thus, it would be desirable to provide a method of holding the beams in their proper positions more effectively so that the expansion joint would be quieter in operation.

In modular expansion joints, the beams are usually separated by extruded resilient seals which must be replaced from time to time. These seals serve to provide lateral support to the beams thereby generally adding strength to the joint. They also protect the internal moving parts of the joint from the weather and dirt which would otherwise be free to enter the joint. The seals are generally kept in place by shoulders formed as part of each beam. One disadvantage of this arrangement is that it is very difficult to remove and replace the seals due to the need to force them around the shoulders. Thus, it would be desirable to provide a means for more easily removing and replacing these seals.

As with most types of construction involving structures supported by abutments, piers, pylons and the like, a certain amount of settling usually occurs in bridge or road construction. This involves changes in vertical and lateral alignment of the bridge sections to be joined which, of course, can adversely affect the performance of expansion joints. Thus, it is desirable to provide an expansion joint whose performance would not be adversely affected by subsequent misalignment due to the settling of the pavement or bridge sections being joined.

OBJECTS OF THE INVENTION

An object of the present invention is to provide an expansion joint which will provide the necessary structual support without necessitating the use of deep recesses in the ends of the pavement sections or bridge sections being joined.

Another object of the invention is to provide an expansion joint which will be quiet in operation.

Another object of the invention is to provide a means for equalizing the spacing and load distribution among the beams contained therein.

Another object of the present invention is to provide a modular expansion joint in which the seals are easily removable.

Another object of the present invention is to provide an expansion joint which will remain satisfactorily operable in spite of the misalignment of the pavement sections being joined due to settling of the abutments or piers or other supporting structures.

SUMMARY OF THE INVENTION

The above and other objects are achieved by the expansion joint according to the present invention which is suited for use in gaps between bridge sections, pavement sections of roadways, sidewalks and the like. The invention provides for proportioning bars extending across the gap and providing structual support, means for defining the motion of the ends of the bars as substantially linear in the general longitudinal direction of the gap and one or more beams mounted on the proportioning bars for providing a wearing surface.

BRIEF DESCRIPTION OF THE DRAWINGS

FIG. 1 is a perspective view showing an expansion joint at the end of a pavement section of a bridge.

FIG. 2 is a cross-sectional view taken along the line 2—2 of FIG. 1 with parts broken away.

FIG. 3 is a top plan view showing the working parts of the invention when the gap being joined is relatively wide.

FIG. 4 is a top plan view showing the same parts shown in FIG. 3 when the gap being joined is relatively narrow.

In FIG. 1 there is shown an expansion joint 10 constructed in accordance with the present invention. The function of the expansion joint is to provide a wearing surface in the gap between pavement sections 11 and 12 which will be structually supported so as to bear the load of vehicles driving across it. Pavement section 11 is shown as being the end of a span of bridge structure. Pavement section 12 is shown as being on land. The invention is equally suitable for use, however, in gaps between other pavement sections whether they be the ends of two spans at an intermediate point on a bridge or pavement sections in a highway where an expansion and contraction must be accommodated. FIG. 1 shows that the expansion joint is supported by an abutment 13. Also shown in FIG. 1 are a number of beams 14, the upper surfaces of which provide a continuation of the driving or wearing surfaces of pavement sections 11 and 12. These beams are separated by resilient sealing members 15. Sealing members 15 can be formed of extruded neoprene material or some other suitable material.

Referring now to FIGS. 2 and 3, it will be seen that the beams 14 are supported by proportioning bars 16 and 17. Although FIG. 3 shows only one proportioning bar supporting each beam 14, it should be understood that at least one more porportioning bar is provided for each beam 14 for stability. However, the structure and operation of the additional proportioning bars is identical to that hereinafter to be described and therefore, they have been omitted. Each proportioning bar is rotabably connected by means of a positioning pin 18 to an associated beam 14. Positioning pin 18 can be a partially threaded bolt which can be screwed into a threaded recess in beam 14. Teflon washers 19 and steel washers 20 are inserted where indicated in FIG. 2.

As shown in FIGS. 2 and 3, each end of a proportioning bar is pivotally connected to a saddle 21. This connection is made by means of a partially threaded bolt 22 and nut 23 or some other appropriate means. Suitable washers 24 are provided inside and outside of the saddle 21 to accommodate pivotal movement of the proportioning bar. As shown in FIG. 5, saddle 21 is rotatably connected to glide platform 37 by means of a partially threaded screw 25 and washers 26. Glide platform 37 is mounted within a glide channel 35 formed in housing 27. As shown in FIG. 5, a rail 29 is provided which will cooperate with an appropriate groove 36 is glide platform 37 to guide the motion of the glide platform. The glide channel 35 is provided with a stainless steel surface 30 while the glide platform 37 is provided with a teflon insert 31 in order to promote the free movement of the glide platform 37 along the glide channel 35. Cushion pot bearings 32 are mounted on glide platform 37 to reduce the play between the top of glide platform 37 and the housing 27.

Each proportioning bar is connected to one beam. The invention contemplates the use of at least two proportioning bars for each beam and the connection between the two would be made at a point along the proportioning bar which would be geometrically appropriate to insure equal spacing between the beams 14 as the expansion joint operates.

Figure 5:
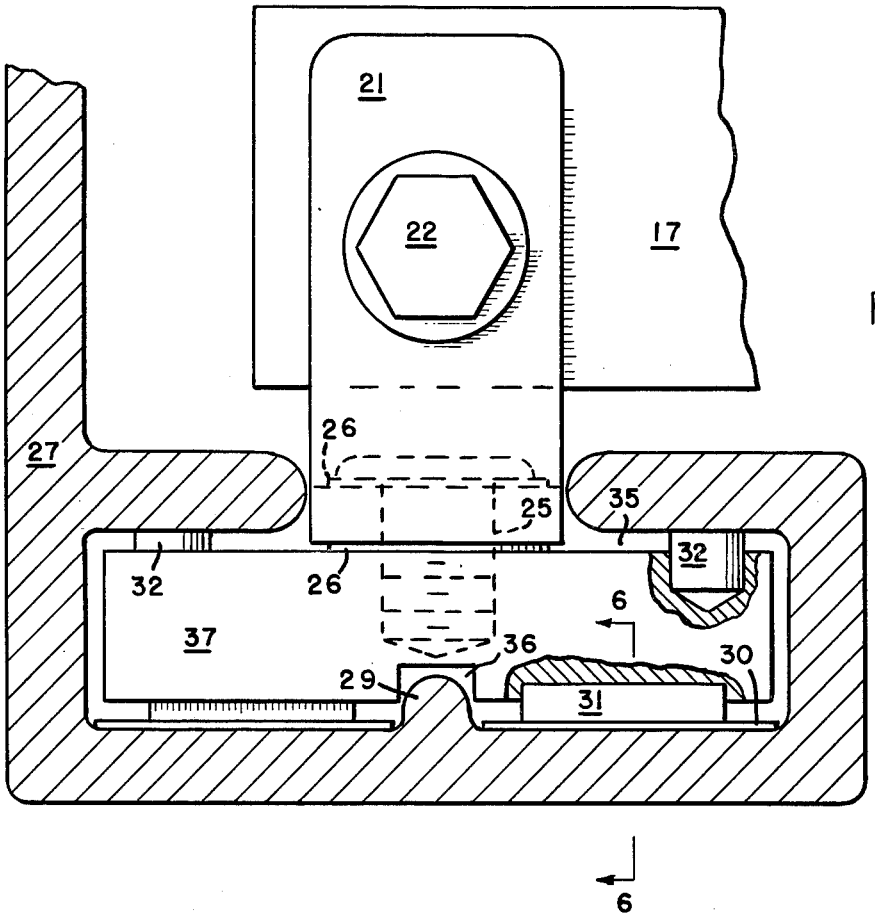
FIG. 5 is a detailed end view of a portion of the invention.
Figure 6:
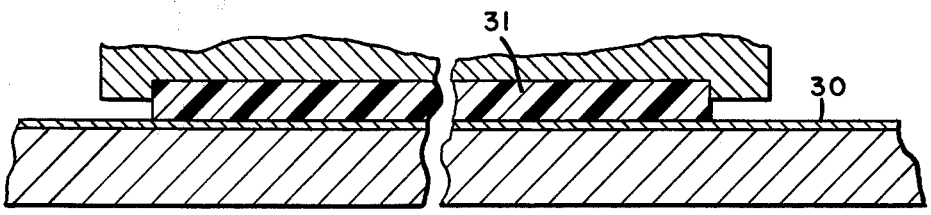
FIG. 6 is a cross-sectional view taken along the line 6—6 as indicated in FIG. 5.

To understand this, one should consider that the ends of the proportioning bars rotate about vertical axes determined by the location of screws 25 as shown in FIG. 5 and that the distance along the bar between these axes determines the effective length of the bar. The vertical face of the portion of each housing 27 in contact with a seal 15 can be aligned with this vertical axis. Then the spaces to be filled by seals 15 can be equalized by the positioning of beams 14 by choosing appropriate points on the proportioning bars for the location of positioning pins 18. For example, with three such spaces (and two beams) the pins 18 for one beam would be placed at a point on the associated proportioning bars equal to one-third of their effective length from one end thereof while the pins for the other beam would be placed at a point equal to two-thirds of such length on its associated proportioning bars. Similarly, if there were four spaces and three beams, the spacing would be at quarter-length intervals, rather than thirds. Where the vertical face of housing 27 is not aligned as described above, the same result can be achieved by another appropriate selection of connecting points for pins 18 as should be apparent to those skilled in the art.

In operation, it will be appreciated that the gliding platforms 37 will move along the glide channel 35 in a direction generally parallel with the line of direction of the gap being joined. FIGS. 3 and 4 show the movement of the parts of the invention as the size of the expansion gap changes. When the gap is at its widest, the proportioning bars tend to be at a greater angle with the beams. As the gap closes in the direction of the arrows, as shown in FIG. 3, the proportioning bars rotate about pin 18, as shown by the arrows on the proportioning bars 16 and 17, making the angle between the proportioning bars and the beams 14 smaller. Those skilled in the art will appreciate that the maximum anticipated angle between the proportioning bars 16 and 17 and the beams 14 must be chosen as sufficiently small to avoid binding of the mechanism. Naturally, this angle would change with the choice of contact sliding materials because the angle at which binding would occur is related to the starting friction of the sliding members of this device.

One of the advantages of the design described above is that the expansion joint can accommodate vertical and lateral misalignments between the pavement or bridge sections being joined. Lateral misalignments are accommodated by the sliding action of the glide platforms 37. As can be appreciated from FIG. 2, vertical misalignments of pavement sections will be accommodated through the pivoting action of the proportioning bars 16 and 17 on bolts 22. These bars would become tilted, thereby proportionately arranging the vertical heights of the beams 14 in order to provide a gradual transition from the vertical level of one pavement section to the other. As one can easily appreciate, the expansion joint according to the present invention will adjust itself and satisfactorily function in the intended manner even though the amount of lateral or vertical dislocation might vary from one point in the joint to another.

It will be noted in FIG. 2 that caps 33 are provided as the wearing surfaces of beams 14. As shown in FIG. 2, these caps are held in place by screws 34. From time to time, it becomes necessary to replace resilient seals 15. As shown, this replacement will be facilitated by the removal of the caps 33.

Also, it will be noted that the edges of the housing 27 and the caps 33 are arcuate in order to provide a smooth and blunt surface, rather than a sharp surface, for contact with the wheels of moving vehicles. This feature also seems to eliminate the danger that snow removal equipment or street cleaning devices would "hang up" on the joint.

Those skilled in the art will realize that not all expansion gaps are perpendicular in direction to the direction of the road or bridge sections being jointed. In other words, the gap may cross the roadway surface at some non-normal angle. The invention will function satisfactorily in such situations without any significant modification. Other gaps may be curved. Here, again, the joint according to the present invention will perform satisfactorily. The housing 27 and glide channel 35 would be curved accordingly and with curves of sufficiently small radii, it would be desirable to round the corners of glide platforms 37 in order to insure their free movement along glide channel 35. Yet other gaps may be comprised of relatively straight sections meeting at angles to one another. In such instances, the beams would be shaped so as to conform to the shape of the gap. The glide platforms 37 would be positioned so as to avoid their having to pass through any angle points. With these modifications and others apparent to those skilled in the art, this invention can readily be adapted for use in the various situations mentioned. It will be appreciated that various other modifications can be made to the preferred embodiment of this invention, as described above, without the departing from the spirit thereof. For example, the number of beams can be increased or decreased in order to accommodate the amount of expansion and contraction which will be experienced in particular applications. It is intended to encompass all such modifications within the following appended claims.

I claim:

1. An expansion joint for use in a gap between pavement sections comprising:

at least one beam running logitudinally in the gap and having a wearing surface substantially coplanar with the wearing surfaces of the pavement sections;

at least a pair of proportioning bars for supporting each beam, said bars extending across the gap at an acute angle with the general line of direction of the gap, and each of said bars being rotatably connected to its associated beam;

a glide channel formed in the ends of each of the pavement sections being joined and defining the permissible motion of an end of each of the proportioning bars as substantially linear in the general line of direction of the gap; and means for slidably mounting the ends of the proportioning bars in the glide channels.

2. The invention of claim 1 wherein each glide channel is defined by the expansion joint housing, said housing being adapted to be connected to the end of a pavement section being joined.

3. The invention of claim 1 further comprising resilient sealing means communicating between each pair of beams and between each beam and the end of the pavement section being joined.

4. The invention of claim 1 wherein the mounting means include means for tilting the proportioning bars as vertical differences occur between the ends of the pavement sections being joined, thereby causing the wearing surface of the beams to be positioned at vertical levels between the levels of the wearing surfaces of the pavement sections.

5. The invention of claim 3 wherein each mounting means further comprises a glide platform slidably mounted within the glide channel, a saddle member rotatably connected to the glide platform and adapted to receive an end of a proportioning bar and means for pivotally connecting an end of a proportioning bar to the saddle member.

6. The invention of claim 5 wherein the glide channel is covered with a stainless steel plate and the sliding block is provided with teflon sliding surfaces.

7. The invention of claim 3 wherein the mounting means include means for tilting the proportioning bars as vertical differences occur between the ends of the pavement sections being joined, thereby causing the wearing surface of the beams to be positioned at vertical levels between the levels of the wearing surfaces of the pavement sections.

8. The invention of claim 7 wherein each glide channel is defined by the expansion joint housing, said housing being adapted to be connected to the end of a pavement section being joined.

9. The invention of claim 8 wherein each mounting means further comprises a glide platform slidably mounted within the glide channel, a saddle member rotatably connected to the glide platform and adapted to receive an end of a proportioning bar and means for pivotally connecting an end of a proportioning bar to the saddle means.

10. The invention of claim 9 wherein the glide channel is covered with a stainless steel plate and the sliding block is provided with teflon sliding surfaces.

11. The invention of claim 10 wherein each beam is provided with a removable cap as its wearing surface, thereby facilitating the installation and removal of the sealing means.

12. The invention of claim 11 wherein the glide platforms are provided with cushion pot bearings adapted to reduce the play between the platforms and the housing.

13. An expansion joint for use in a gap between pavement sections comprising:

at least one beam running longitudinally in the gap and having a wearing surface substantially coplanar with the wearing surfaces of the pavement sections;

a resilient seal between each pair of beams and between each beam and the end of a pavement section;

at least a pair of proportioning bars, said bars extending across the gap at an acute angle with the general line of direction of the gap;

a glide channel formed in the ends of each of the pavement sections being joined and defining the permissible motion of an end of each of the proportioning bars as substantially linear in the general line of direction of the gap;

means for slidably mounting the ends of the proportioning bars in the glide channels.

14. The invention of claim 13 wherein the mounting means include means for tilting the proportioning bars as vertical differences occur between the ends of the pavement sections being joined.

15. The invention of claim 14 wherein each glide channel is defined by the expansion joint housing, said housing being adapted to be connected to the end of a pavement section being joined.

16. The invention of claim 15 wherein each mounting means further comprises a glide platform slidably mounted within the glide channel, a saddle member rotatably connected to the glide platform and adapted to receive an end of a proportioning bar and means for pivotally connecting an end of a proportioning bar to the saddle means.

17. The invention of claim 16 wherein the glide channel is covered with a stainless steel plate and the sliding block is provided with teflon sliding surfaces.

* * * * *